US008124176B2

(12) United States Patent
McCleskey et al.

(10) Patent No.: US 8,124,176 B2
(45) **Date of Patent: *Feb. 28, 2012**

(54) POLYMER-ASSISTED DEPOSITION OF FILMS

(75) Inventors: Thomas M. McCleskey, Los Alamos, NM (US); Anthony K. Burrell, Los Alamos, NM (US); Quanxi Jia, Los Alamos, NM (US); Yuan Lin, Chandler, AZ (US)

(73) Assignee: Los Alamos National Security, LLC, Los Alamos, NM (US)

( * ) Notice: Subject to any disclaimer, the term of this patent is extended or adjusted under 35 U.S.C. 154(b) by 1229 days.

This patent is subject to a terminal disclaimer.

(21) Appl. No.: 11/804,472

(22) Filed: May 17, 2007

(65) Prior Publication Data

US 2008/0050528 A1 Feb. 28, 2008

Related U.S. Application Data

(63) Continuation-in-part of application No. 10/888,868, filed on Jul. 8, 2004, now Pat. No. 7,604,839, which is a continuation-in-part of application No. 10/616,479, filed on Jul. 8, 2003, now Pat. No. 7,365,118, which is a continuation-in-part of application No. 09/629,116, filed on Jul. 31, 2000, now Pat. No. 6,589,457.

(51) Int. Cl.
*B05D 3/04* (2006.01)
*B05D 3/02* (2006.01)

(52) U.S. Cl. ..... 427/226; 427/376.6; 427/377

(58) Field of Classification Search ..... 427/226, 427/377, 376.6

See application file for complete search history.

(56) References Cited

U.S. PATENT DOCUMENTS

| | | | | |
|---|---|---|---|---|
| 3,904,448 | A | 9/1975 | Takahashi et al. | |
| 4,931,100 | A * | 6/1990 | Johnson | 524/35 |
| 4,950,626 | A * | 8/1990 | Birchall et al. | 501/88 |
| 5,116,679 | A * | 5/1992 | Nadkarni et al. | 428/367 |
| 7,081,271 | B2 | 7/2006 | Chung et al. | |
| 2004/0253386 | A1 | 12/2004 | Deevi et al. | |
| 2005/0043184 | A1 | 2/2005 | McCleskey et al. | |

* cited by examiner

*Primary Examiner* — Kirsten Jolley
(74) *Attorney, Agent, or Firm* — Bruce H. Cottrell; Samuel L. Borkowsky

(57) ABSTRACT

A polymer assisted deposition process for deposition of metal nitride films and the like is presented. The process includes solutions of one or more metal precursor and soluble polymers having binding properties for the one or more metal precursor. After a coating operation, the resultant coating is heated at high temperatures under a suitable atmosphere to yield metal nitride films and the like. Such films can be conformal on a variety of substrates including non-planar substrates. In some instances, the films can be epitaxial in structure and can be of optical quality. The process can be organic solvent-free.

7 Claims, 8 Drawing Sheets

POLYMER-ASSISTED DEPOSITION OF FILMS

This application is a continuation-in-part of U.S. Ser. No. 10/888,868, filed Jul. 8, 2004, now U.S. Pat. No. 7,604,839 by McCleskey et al., which is a continuation-in-part of U.S. Ser. No. 10/616,479, filed Jul. 8, 2003, now U.S. Pat. No. 7,365,118 by McCleskey et al., which is a continuation-in-part of U.S. Ser. No. 09/629,116, filed Jul. 31, 2000, by Li et al., and issued Jul. 8, 2003 as U.S. Pat. No. 6,589,457.

STATEMENT REGARDING FEDERAL RIGHTS

This invention was made with government support under Contract No. DE-AC52-06NA25396 awarded by the U.S. Department of Energy. The government has certain rights in the invention.

FIELD OF THE INVENTION

The present invention relates to a deposition technique for metal films, in particular metal nitride films, and more particularly to polymer assisted solution deposition of such metal nitride films or epitaxial metal nitride films.

BACKGROUND OF THE INVENTION

There has been considerable interest in high quality nitride films because of their important properties and applications in semiconductor, electronic and optoelectronic industry. For example, titanium nitride (TiN) exhibits high hardness, high chemical and thermal stability, low electrical resistivity, and excellent adhesion to substrates, that make TiN the most popular and widely studied material in the semiconductor industry. Aluminum nitride (AlN0 has a wide band-gap of 6.2 eV, high thermal conductivity, strong piezoelectricity and good thermal stability, which makes it suitable as a substrate for UV detectors and blue emitting LEDs. Titanium-aluminum-nitride ($Ti_{1-x}Al_xN$) composites may take advantage of properties of both TiN and AlN, such as they have a high melting point, chemical inertness, superior oxidation resistance and good thermodynamic stability. Because of these properties, they are excellent candidates for use as optical coatings in industry, diffusion barriers in microelectronics, electrodes in micro-electro-mechanical devices, and hard wear-resistant coatings in machining applications.

Nitride materials such as titanium nitride (TiN), aluminum nitride (AlN), and gallium nitride (GaN) can be deposited in the form of films by physical vapor depositions such as magnetron sputtering, ion beam sputtering, ion beam assisted deposition (IBAD), arc evaporation, electron-beam (e-beam) evaporation, atomic layer deposition, thermal evaporation, molecular beam epitaxy (MBE) and pulsed laser deposition (PLD). Chemical vapor depositions such as plasma-enhanced chemical vapor deposition (PECVD), low-pressure chemical vapor deposition (LPCVD), and metalorganic chemical vapor deposition (MOCVD) have also been used. However, these deposition techniques have their limitations due to the cost of equipment, the ability to coat only flat surfaces, and the ability to coat only surfaces of limited size.

Chemical solution deposition techniques have been generally viewed as less capital intensive (see, Lange, "Chemical Solution Routes to Single-Crystal Thin Films", Science, vol. 273, pp. 903-909, 1996 and Schwartz, "Chemical Solution Deposition of Perovskite Thin Films", Chemical Materials, vol. 9, pp. 2325-2340, 1997). Also, chemical solution techniques are not generally limited to flat surfaces.

U.S. Pat. No. 6,589,457 by Li et al. is directed to deposition of metal oxides from aqueous solutions of water-soluble metal precursors and water-soluble polymers. While none of the examples included a polymer other than polyvinyl alcohol, Li et al. illustrate the continuing efforts in the development of chemical solution deposition processes.

SUMMARY OF THE INVENTION

To achieve the foregoing and other objects, and in accordance with the purposes of the present invention, as embodied and broadly described herein, the present invention provides for a process of preparing a conformal metal nitride film including applying a homogenous solution, said solution containing a soluble metal precursor and a soluble polymer in a suitable solvent, onto a substrate to form a polymer and metal containing layer thereon, said polymer characterized as having metal binding properties, and, heating said substrate in a reducing atmosphere at temperatures and for time characterized as sufficient to remove said polymer from said polymer and metal containing layer and form a conformal metal nitride film.

The present invention further provides for a process of preparing a uniform highly ordered metal nitride film including applying a homogenous solution, said solution containing a soluble metal precursor and a soluble polymer in a suitable solvent, onto a substrate to form a polymer and metal containing layer thereon, said polymer characterized as having metal binding properties, and, heating said substrate in a reducing atmosphere at temperatures and for time characterized as sufficient to remove said polymer from said polymer and metal containing layer and form a uniform highly ordered metal nitride film

BRIEF DESCRIPTION OF THE DRAWINGS

FIG. 7(*b*) shows $Ti_{1-x}Al_xN$ (x=0-0.5, 1) films on $LaAlO_3$ substrates where all films were prepared from Ti-EDTA solutions.

DETAILED DESCRIPTION

Figure 1:
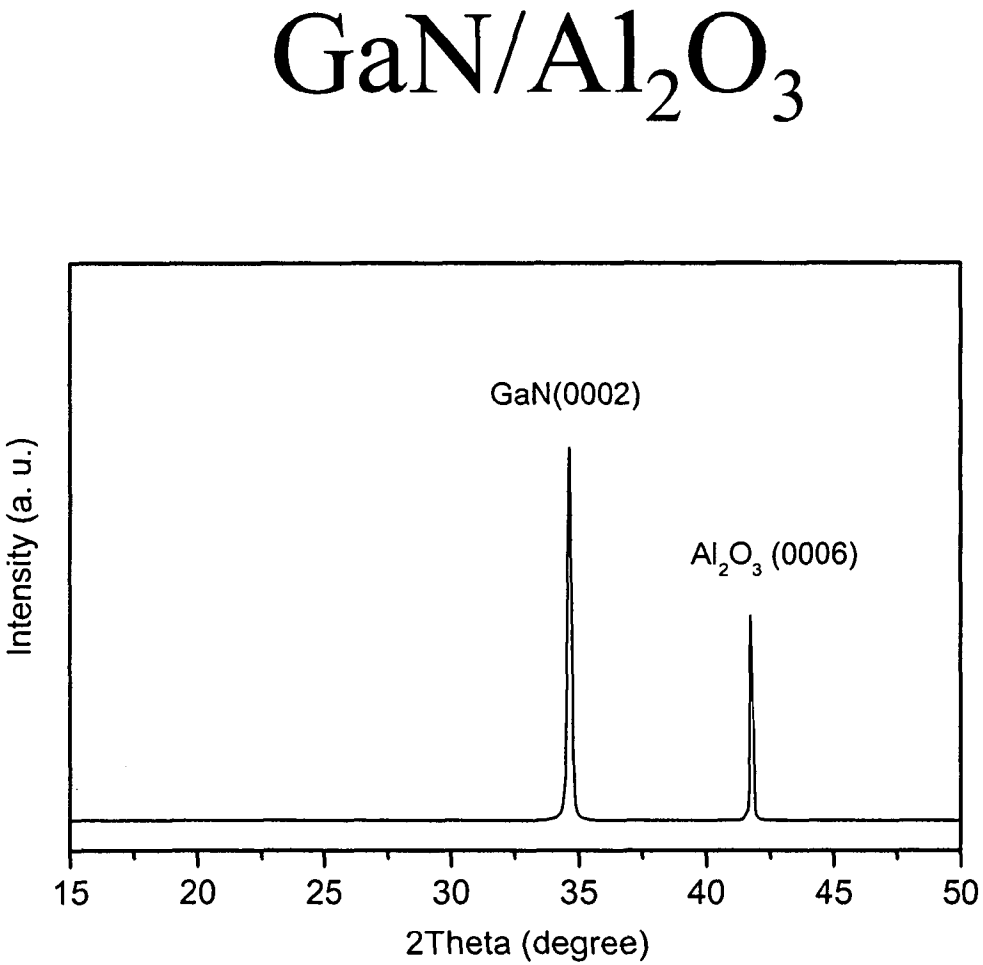
FIG. 1 shows the x-ray diffraction 2θ-scan of a gallium nitride (GaN) film deposited by the process of the present invention on c-plane sapphire substrate. The GaN film is preferentially oriented out of the plane.
Figure 2:
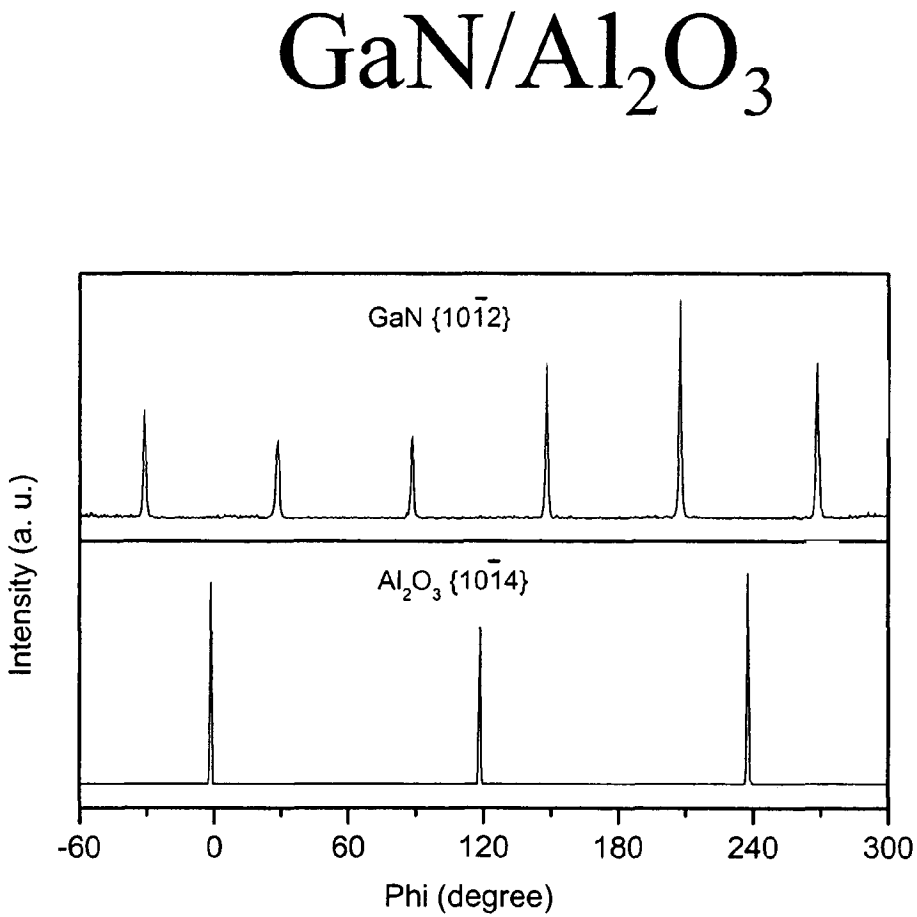
FIG. 2 shows the x-ray diffraction ϕ-scan of GaN (10-12) and $Al_2O_3$ (10-14) respectively. The epitaxial nature of the GaN film deposited by the process of the present invention can be clearly seen from the diffraction patterns in FIG. 1 and FIG. 2.
Figure 3:
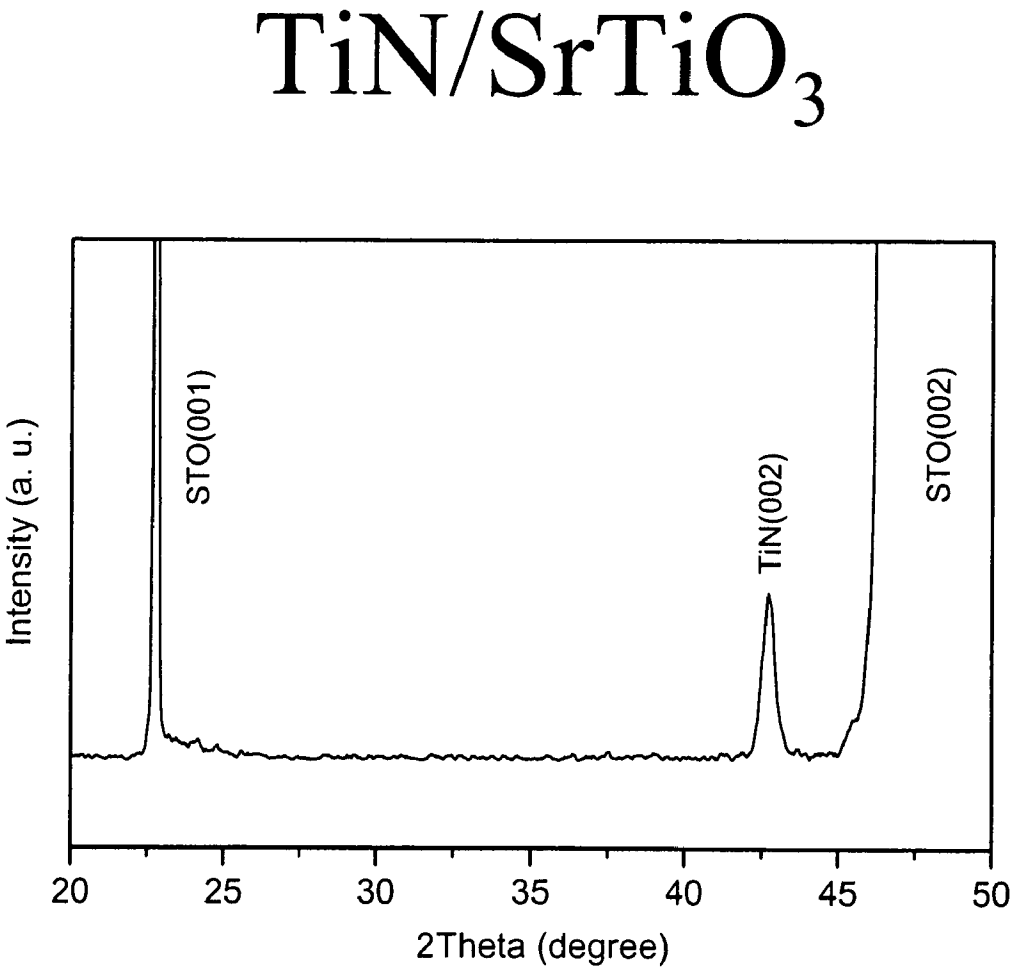
FIG. 3 shows the x-ray diffraction 2θ-scan of a titanium nitride (TiN) film deposited by the process of the present invention on a strontium titanate ($SrTiO_3$) substrate. The GaN film is preferentially oriented out of the plane.
Figure 4:
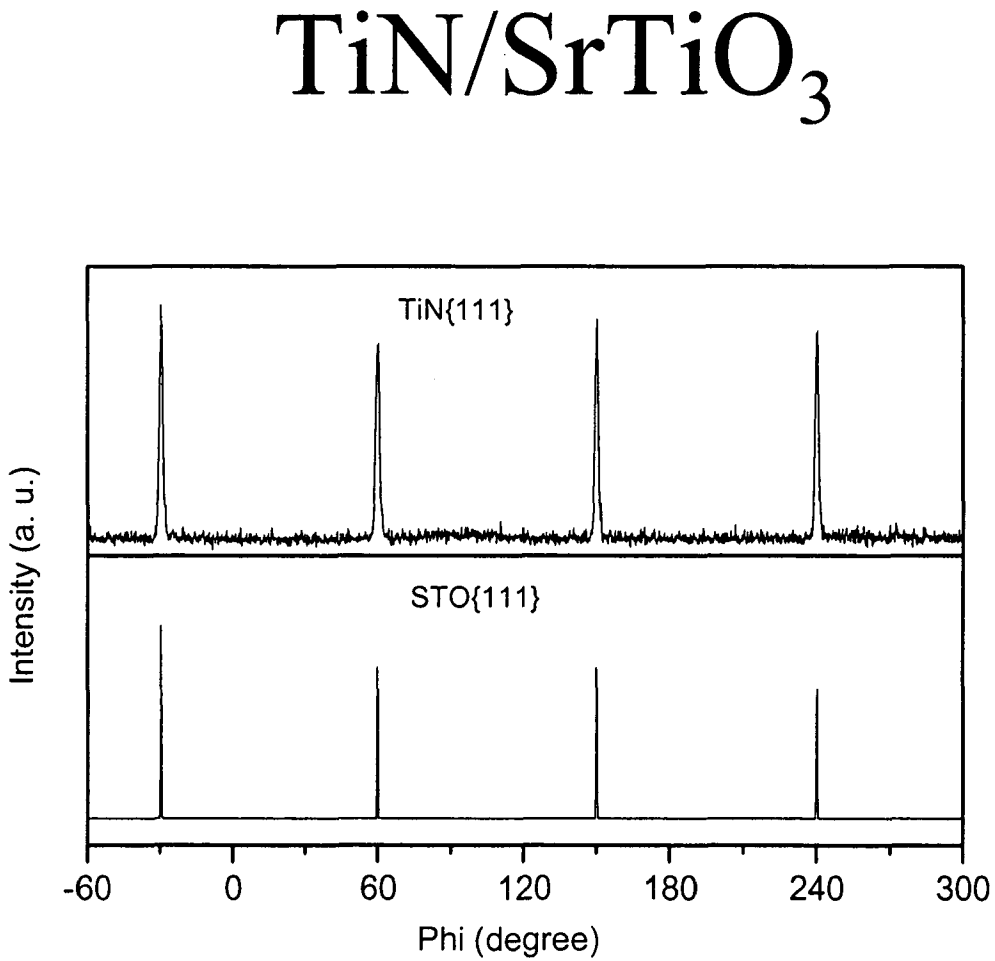
FIG. 4 shows the x-ray diffraction ϕ-scan of TiN (111) and $SrTiO_3$ (111) respectively. The epitaxial nature of the TiN film deposited on the $SrTiO_3$ by the process of the present invention can be clearly seen from the diffraction patterns in FIG. 3 and FIG. 4.
Figure 5:
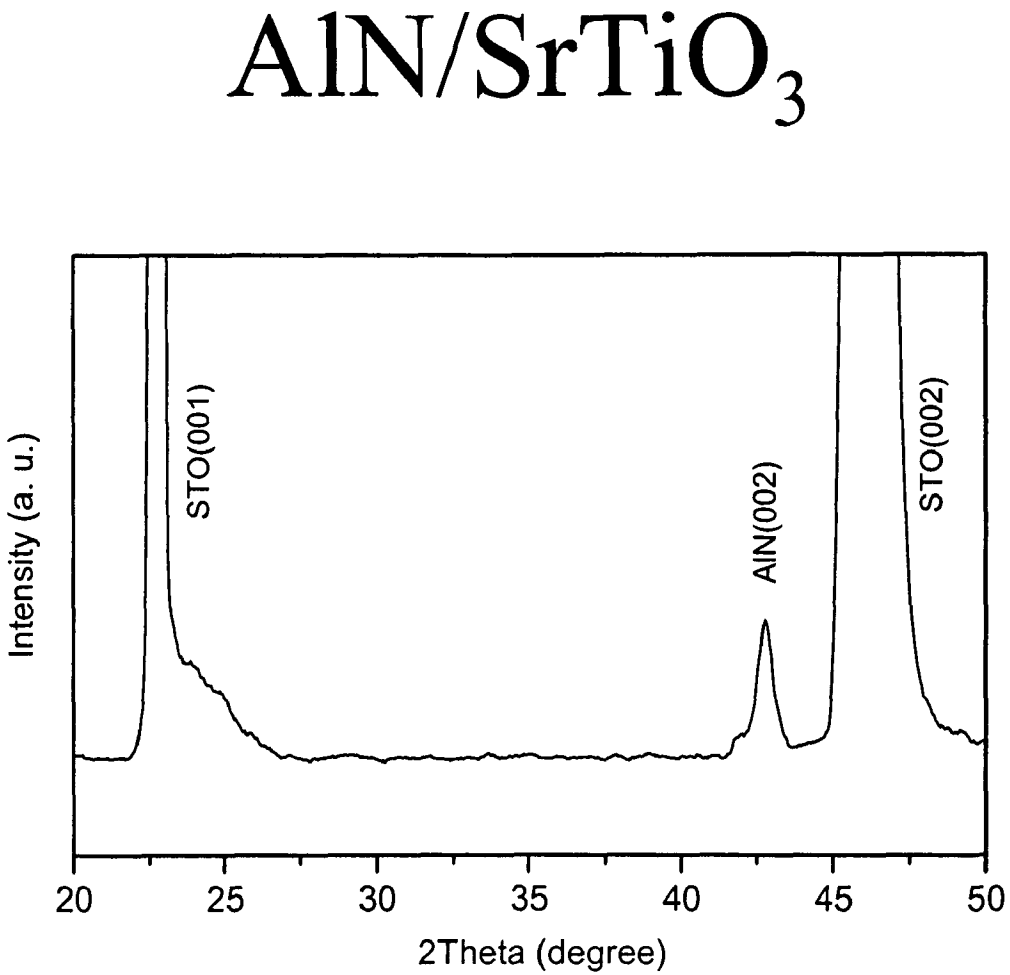
FIG. 5 shows the x-ray diffraction 2θ-scan of an aluminum nitride (AlN) film deposited by the process of the present invention on a strontium titanate ($SrTiO_3$) substrate. The AlN film is preferentially oriented out of the plane.
Figure 6:
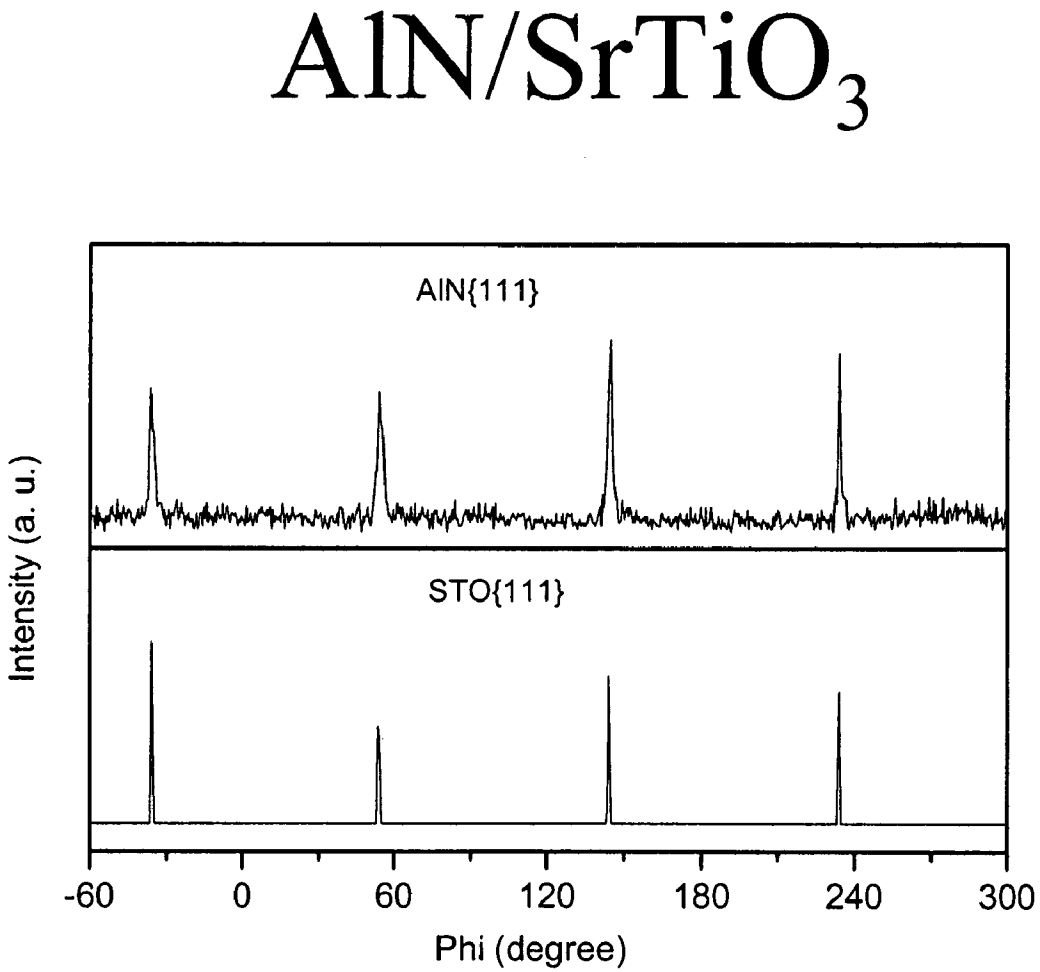
FIG. 6 shows the x-ray diffraction ϕ-scans from AlN (111) and $SrTiO_3$ (111) respectively substrate. The epitaxial nature of the AlN film deposited on (001)?? $SrTiO_3$ by the process of the present invention can be clearly seen from the diffraction patterns in FIG. 5 and FIG. 6.

The present invention provides a chemical solution deposition method of forming metal nitride films, such a chemical solution deposition method including the deposition of a metal precursor and a soluble polymer where the polymer has binding properties for the metal precursor. The structure of the metal nitride film can be amorphous, composite, polycrystalline, nanocrystalline, microcrystalline, or epitaxial depending upon the chemistry of the solution, the substrate used for the film deposition and growth and the post-thermal treatment conditions.

The present invention is concerned with a process for preparing metal-containing films such as metal nitride films and the like, from solutions, optionally in an organic solvent-free process. The metal nitride films can be prepared with an epitaxial structure. The elimination of organic solvents from chemical solution deposition techniques can be preferred in some instances. Additionally, it has been found that the metal-containing films made in accordance with the present invention can be formed crack-free. This is in contrast to the cracking that sometimes resulted in various prior techniques.

The process of the present invention uses a soluble polymer to assist in the deposition of the desired metal nitride. Thus, the process can be referred to as a polymer assisted deposition (PAD) process. Inclusion of a soluble polymer with a single metal precursor or multiple metal precursors promotes better distribution of the materials during the deposition. The polymer can be removed subsequently by heating at sufficiently high temperatures to eliminate the polymer and leave a metal nitride film. The resultant metal nitride film can be prepared with orientation, i.e., the film can be prepared with an epitaxial structure. By using a soluble polymer in conjunction with one or more metal precursors, single or mixed compound/complex metal nitride films can be prepared. In one embodiment, the overall process can be an aqueous process that can be organic solvent free. Formation of the nitride depends upon the proper selection of precursor and atmosphere during heating. The polymer cannot only control the desired viscosity for the process, but also binds the metal ions to prevent premature precipitation and formation of metal oxide oligomers. The results are found to be a homogeneous distribution of the metal precursors in the solution and the formation of uniform metal organic films. PAD can grow high quality epitaxial cubic TiN, AlN and $(Ti_{1-x}Al_x)N$ films on substrates of, e.g., $SrTiO_3$ or $LaAlO_3$.

The heating of the polymer and metal layer is generally carried out under a reducing atmosphere. Of example, in the case where it is desired to reduce a metal precursor to obtain a metal nitride film, the reducing atmosphere can include, e.g., hydrogen, ammonia, formaldehyde, carbon monoxide, formic acid or other reducing agents well known to those skilled in the art.

While a metal nitride film can be prepared with an highly ordered structure, e.g., an epitaxial structure, by the process of the present invention, it may also be prepared with an amorphous structure or a nanocrystalline structure or a polycrystalline structure by suitable treatment after deposition of the polymer and metal containing layer upon a substrate or by suitable selection of the substrate. By "highly ordered" is meant ordering with a preferred orientation as can be seen in XRD measurements. Such amorphous or polycrystalline structures may be preferred for some applications.

The metal-containing films (the metal, the nitride and the like) of the present invention are uniform films, i.e., they are continuous films covering the target substrate. They can also be readily formed as conformal films upon non-planar substrates or surfaces.

The soluble polymer used in the present process has binding properties for the metal precursors used to form the metal nitride film and can be, e.g., polyethylenimine (PEI), a substituted PEI or PEI derivative such as a carboxylated-polyethylenimine (PEIC), a phosphorylated-polyethylenimine (PEIP), a sulfonated-polyethylenimine (PEIS), an acylated-polyethylenimine, hydroxylated water-soluble polyethylenimines and the like or a polymer such as polyacrylic acid, polypyrolidone, and poly(ethylene-maleic acid). PEI or substituted PEIs such as PEIC are generally the preferred polymers. Substituted or PEI derivatives are post modified after formation of the base polymer. Typically, the molecular weight of such polymers is greater than about 30,000. By "binding" it is meant that the polymer and the metal are bound through any of various mechanisms such as electrostatic attraction, hydrogen bonding, covalent bonding and the like.

In order to have good processing characteristics, a precursor solution for metal nitride films must have a suitable viscosity. In the present invention, polymer plays dual functions. In other words, a polymer is also used to assist the viscosity desired for metal nitride film processing.

The solutions used in depositing the polymer and metal to the substrates are homogeneous solutions. By "homogeneous" is meant that the solutions are not dispersions or suspensions, but are actual solutions of the polymer, metal complexes and any metal binding ligands.

The criteria on the choice of polymers are that they be soluble, undergo a clean decomposition upon heating at high temperatures, e.g., temperatures over about 250° C., and are compatible with the metal compounds. PEI decomposes completely and cleanly above 250° C. and leaves no residual carbon in the film. This feature makes PEI and derivatives thereof especially preferred polymers in the practice of the present invention.

By aiding in the desired viscosity, such polymers can allow processing of the metal nitride precursor solution into desired configurations such as films. The desired viscosity can be achieved through controlling the solution concentration of the soluble polymers and by controlling the molecular weight of the polymer. For high quality homogeneous films, polymer concentrations and the polymer ratio to metal components should be maintained at a proper balance. The rheology of the metal nitride precursor solution can also be important for the morphology and quality of the final metal nitride films. In order to form smooth films, the polymer solution must have suitable rheological properties so that any spin-coated film has no undesired patterns associated with polymer rheological properties.

The polymer further functions as binding agent to the metals within the precursor solution in assisting the formation of an intermediate deposited polymer-metal composite film and ultimately a metal nitride film. This requires that the polymer should also have suitable interactions to metal ions such that no phase separation occurs during the deposition processes. Thereafter, the deposited polymer-metal composite films are heated at high temperatures, e.g., at temperatures above about 250° C. to obtain the final metal nitride films. Thus, the soluble polymer selection should also have suitable decomposition characteristics, e.g., a clean decomposition under such conditions, so that the final metal nitride film can be free of side products.

The general approach of the present invention can be applied to metal nitrides.

Among the transition metals are included titanium, vanadium, chromium, manganese, iron, cobalt, nickel, copper, zinc, yttrium, zirconium, niobium, palladium, platinum, molybdenum, ruthenium, rhodium, cadmium, hafnium, tantalum, tungsten, rhenium, osmium, and iridium.

Among the lanthanide metals are included lanthanum, cerium, praseodymium, neodymium, samarium, europium, gadolinium, terbium, dysprosium, holmium, erbium, thulium, ytterbium and lutetium.

The present invention may also employ fluoride complexes as precursors in the process of the present invention. For example, a gallium hexafluoride anion ($GaF_6^{3-}$) can be formed by the addition of gallium nitrate and ammonium bifluoride and can be used as the metal precursor.

The metal nitride films prepared by the present process can include a metal nitride with a single metal, can be a metal nitride with two metals or three metals or may be a metal nitride including four or more metals. Among the metal nitrides than can be prepared by the present process are included titanium nitride, aluminum nitride, and the like. Among the mixed metal nitrides that can be prepared by the present process are included titanium-aluminum nitride and the like. The metal nitride films prepared by the present process can be insulating, resistive, conductive, ferroelectric, ferromagnetic, piezoelectric, and even superconductive depending upon the chemical compositions and microstructures.

Metal nitride films that can be prepared by the present process can include a metal nitride with a single metal, can be a metal nitride with two metals or three metals or may be a metal nitride including four or more metals. Among the metal nitrides that can be prepared by the present process are included titanium nitride, gallium nitride and tantalum nitride and the like. Among the mixed metal nitrides that can be prepared by the present process are included tantalum niobium nitride and the like. The metal nitride films prepared by the present process can be serve as wide bandgap semiconductors as hardening materials and can be insulating, resistive, conductive, ferroelectric, ferromagnetic, and piezoelectric, depending upon the chemical compositions and microstructures. The preparation of metal nitride films can be accomplished by depositing a polymer and metal containing layer upon a suitable substrate, but the heating can then be conducted under an ammonia-containing atmosphere or a reducing atmosphere to yield the desired nitride materials.

In one aspect of the present invention, composites can be prepared including the various metal-containing nitride films as described with various additional additives to provide tailoring of the material properties. Among the additives can be nanoparticles, especially nanoparticles of various metals such as transition metals, lanthanide metals or main group metals, nanoparticles of various metal oxides including one or more metal such as a transition metal, a lanthanide metal or a main group metal, nanoparticles of various metal nitrides including one or more metal such as a transition metal, a lanthanide metal or a main group metal, nanoparticles of various metal carbides including one or more metal such as a transition metal, a lanthanide metal or a main group metal, nanoparticles of various metal chalcogenides including one or more metal such as a transition metal, a lanthanide metal or a main group metal, nanoparticles of various metal pnictogenides including one or more metal such as a transition metal, a lanthanide metal or a main group metal, nanoparticles of various metal borides including one or more metal such as a transition metal, a lanthanide metal or a main group metal, or nanoparticles of various metal silicides including one or more metal such as a transition metal, a lanthanide metal or a main group metal. Examples of such nanoparticles can include titanium dioxide, strontium oxide, erbium oxide and the like, such nanoparticles suitable for modifying the electronic properties of metal nitride films of a different material.

Other additives may include silicon beads, which may provide void properties to the various metal containing films in accordance with the present invention. Additionally, various dendrimer systems such as PAMAM-4 dedrimer (available from Aldrich Chemical Co.) and the like may be added and may provide a dopant to the various metal containing films in accordance with the present invention. Also, various quantum dot materials, e.g., cadmium selenide dots having a coating of zinc sulfide, such quantum dot materials being well known to those skilled in the art, may be added to the various metal containing films in accordance with the present invention.

The composition, e.g., solution, used for the deposition includes the soluble polymer and the metal precursors. In addition, other metals can be included through addition of appropriate metal salts. For example, barium can be added through a barium salt such as barium acetate. Other suitable metal salts may include metal nitrates, metal oxalates, metal acrylates, and metal coordination complexes.

The solvent for dissolution of the soluble polymer can be, e.g., water, lower alcohols such as methanol, ethanol, propanol and the like, acetone, propylene carbonate, tetrahydrofuran, acetonitrile, acetic acids and mixtures thereof such as water and ethanol and the like. As the soluble polymer used in the present invention includes binding properties for the metals or metal precursors used in formation of the metal nitride films, the polymer can help provide the necessary solubility to the respective metals, e.g., metal precursors. In some instances, the metal can initially be in a metal complex such as a complex of the respective metal with a metal binding ligand or salt thereof such as ethylenediaminetetraaceticacid (EDTA) or salts thereof such as dipotassium ethylenediaminetetraaceticacid. EDTA-metal complexes are generally soluble within solutions including a soluble polymer with binding properties for the metal precursors such as PEI and the like.

Among suitable metal binding ligands besides EDTA and salts thereof can be included other carboxylic acid ligands such as ethylenediaminediaceticacid (EDDA), trans-1,2-diamino-cyclohexan-N,N,N',N'-tetraacetic acid (CDTA), ethyleneglycol-O,O'-bis-(2-aminoethyl)-N,N,N',N'-tetraacetic acid (EGTA), diethylenetriamine-pentaacetic acid (DTPA), N-(2-hydroxyethyl)-ethylenediamine-N,N',N'-triacetic acid (HEDTA), nitrilotriacetic acid (NTA), triethylentetramine-N,N,N',N'',N''',N''''-hexaacetic acid (TTHA) and the like, polypyridyl ligands such as terpyridne, 2,2'-bypyridine, 1,10-phenanthroline and the like, beta-diketone (acetylacetonate) ligands such as 2,4-propanedione and derivatives thereof, catecholate and aryl oxide or alkyl oxide ligands, macrocyclic ligands such as cyclam, cyclen, triazacyclononane and derivatives thereof, or other simple ligands such as aquo ($H_2O$) and amines ($NH_3$), i.e., $Co(NH_3)_6^{2+}$. Shiff-base ligands such as trimethylenediamainetetramethylglyoximato ligand or the salen type ligands may also be used.

The starting solution is typically maintained at ambient temperatures from about 15° C. to about 30° C., more usually from about 20° C. to about 25° C. Within those temperature ranges, the materials added to the solution are soluble. In preparation of solutions used in the present process, the solutions using a polyethylenimine as the metal binding polymer can be filtered prior to use to remove any non-soluble components. One exemplary process in the preparation of the solutions involves filtering the precursor solution through an Amicon ultrafiltration unit containing a PM 10 ultrafiltration membrane. Such a filter is designed to pass materials having a molecular weight of less than about 10,000 g/mol (e.g., unbound metal, smaller polymer fragments and the like) while retaining the desired materials of a larger size. Ultrafiltration allows for removal of any unwanted salts such as cations, anions or other impurities.

The metal ratio can be controlled through appropriate addition of metal precursors to the solvent used in the deposition. Such solutions can generally have a shelf life of more than a year.

In one embodiment of the present invention, the starting solution can be deposited on a desired substrate, e.g., by spray coating, dip coating, spin coating, ink jet printing and the like. After deposition of the starting solution on a substrate, the deposited coating must be heated under a suitable atmosphere at high temperatures of from about 250° C. to about 1300° C., preferably from about 400° C. to about 1200° C. for a period of time sufficient to remove the polymer and to form only the metal nitride film. Heating times may be varied and may be longer depending upon the thickness of the deposited film.

Optionally, the deposited coating can be initially dried by heating to temperatures of from about 50° C. to about 150° C. for from about 15 minutes to several hours, preferably for less than one hour. The deposited polymer-metal containing film undergoes removal of a percentage of volatile species during such an initial drying stage.

The resultant metal nitride films from the present process have been optical quality films in that they are highly smooth films with a mirror-like appearance. Some of the films have been found to be epitaxial in structure. Conformal coatings can be important in many instances of non-planar substrates and the present coatings can be deposited conformally.

The present invention enables the processing of metal nitride films with convenience and flexibility required in industrial fabrication. This process involves making metal nitride films from solutions—optionally in an organic solvent-free process. Gallium nitride (GaN) and aluminum nitride (AlN) films have been prepared using polymer-assisted aqueous deposition (PAD) techniques. X-ray diffraction measurement indicates that the gallium nitride and aluminum nitride films on substrates, such as $Al_2O_3$ and $SrTiO_3$, can be preferentially oriented out of plane. They can also be epitaxial as confirmed from x-ray ϕ-scans of the diffraction of the films and transmission electron microscopy.

The polymer is used to bind metals and metal precursors. This allows the removal of any unwanted anions or cations by filtration, e.g., through an Amicon ultrafiltration unit, and can bring multiple metals together in a homogeneous manner at a molecular level. This also prevents selective precipitation of unwanted metal oxide phases as a portion of the water can be removed and the metals concentrated within the remaining solution. Even at the extreme of just polymer and metal, the dried solution (a gel) includes only well dispersed metal atoms bound to the polymer. This can be done in one of three ways.

In a first manner, a single polymer (such as carboxylated polyethyleneimine) can be added to a solution containing simple salts (such as nitrate) of two or more metals in the correct ratio. If the binding constant is high for both metals then they will remain in the correct ratio during filtration and concentration of the polymer.

In a second manner, the metals can be bound individually to one or more polymers and concentrated. The resulting solution can be examined by ICP to determine metal content and then mixed appropriately prior to spin coating. Different polymers and different solvents can be used for different metals in this system.

In a third manner, metal complexes such as a metal-EDTA complex can be prepared and mixed in the desired ratios. These complexes can then be bound to a polymer (such as polyethyleneimine) and concentrated.

Regardless what materials being coated by PAD, a post thermal-treatment process is necessary to burn off the polymer, and to form the right phase of the materials.

The choice of substrate materials is closely related to the applications. For example, glass can be used as a substrate if transparent film is needed. On the other hand, lattice constant matched substrate is needed if epitaxy is the objective. For example, we have used c-plane sapphire as the substrate for epitaxial growth of GaN. Other materials such as $SrTiO_3$ can be used as the substrate for epiatxial growth of TiN and AlN. TiN has also been deposited on silicon (Si) and stainless steels (to increase the hardness).

The coating is done using a spin coater. The spin seed is controlled in the range of 1000 3000 RPM depending on the viscosity of the solutions. It should be noted that other coating techniques such as dip-coating can be also used since this technology uses solution.

The post-thermal treatment conditions such as post-annealing temperature and ambient change in a wide range depending on the objectives of the materials deposited. For example, to grow epitaxial nitride films on c-plane sapphire substrate, we used a slow warming up (1~10° C./min) from room temperature to 500° C. was used in an atmosphere of a forming gas (about 6% $H_2$ and about 94% $N_2$) to make sure that the polymers will be completely burned off. Then the annealing was ramping up (at a rate of 60° C./min) to a higher temperature (650 to 1000° C.) for the formation of right phase and structures. This was done in an ammonia environment. The choice of final annealing temperature depends on the microstructures required if an epitaxial growth is preferred.

The epitaxial growth of GaN, TiN, and AlN on different substrates can be clearly seen from the x-ray diffraction results shown in FIGS. 1-6.

The hardness of stainless steels has also been tested before and after depositing of TiN by PAD. In this case, the TiN is believed to be a polycrystal since no suitable template is provided for epitaxial growth. Also, the annealing temperature in this case was much lower than that used for epitaxial growth. We just treated the TiN at a temperature of 700° C. The hardness of the TiN coated stainless steel was enhanced by a factor of 4 compared with the bare stainless steel.

Two different kinds of Ti solutions, and one Al solution were used in initial testing. The precursor solutions with desired stoichiometric molar ratio for $(Ti_{1-x}Al_x)N$ from Ti and/or Al solutions were spin-coated on quartz glass, single crystalline (001) $SrTiO_3$, or (001) $LaAlO_3$ substrates. The films were heated in forming gas (a mixture of about 6 percent hydrogen gas and about 94 percent nitrogen gas by volume) at 510° C. for 2 hours, then annealed in ammonia gas at 900-1000° C. for 1 hour. Films with about a 40-50 nm thickness were obtained for one spin-coat. The film thickness could be increased with multiple spin-coats. TiN, AlN and $(Ti_{0.5}Al_{0.5})N$ films were first prepared on quartz glass and checked by XRD. The XRD patterns showed that TiN films and $(Ti_{0.5}Al_{0.5})N$ films annealed at 900-950° C. formed with a single phase cubic B1 NaCl structure. Under the same conditions, no XRD peaks appear for the AlN films, indicting that AlN films are amorphous, and the crystalline temperature for AlN is higher than TiN. The XRD pattern for AlN films annealed at 1000° C. showed AlN formed with a hexagonal structure on quartz. No other detectable phases such as $TiO_2$ or $Al_2O_3$ were observed, indicating that these nitride films do not have observable oxygen contamination. $Ti_{1-x}Al_xN$ (x=0, 0.1, 0.2, 0.3, 0.4, 0.5, and 1) films were then deposited on $SrTiO_3$ or $LaAlO_3$ substrates to achieve epitaxial growth. The XRD results from the θ-2θ scan and the phi (ϕ) scan for TiN and AlN films annealed at 950-1000° C. on $SrTiO_3$ substrates showed only (002) peak from the TiN or the AlN, indicating that the films were preferentially oriented along the c-axis perpendicular to the substrate surface. The in-plane orientation between the film and substrate was determined by XRD ϕ-scans from (111) TiN or AlN and (111) $SrTiO_3$ substrate, respectively. Four peaks appeared in the ϕ-scans. An average FWHM value of 1.2° for TiN and 2° for AlN films as compared to 0.7° for that of the single crystal $SrTiO_3$, indicated the film to be of good epitaxial quality. θ-2θ scan and the ϕ scan for all the $(Ti_{1-x}Al_x)N$ (x=0-0.5, and 1) films were the same except small shift of the (002) peak, such as 2θ value of 43.08° for TiN, moves to 43.09° for $Ti_{0.5}Al_{0.5}N$ and 43.12° for AlN film, suggesting formation of the solid solution with the same structure. All films were found to have single phase cubic structure exhibiting an eptiaxial cube-on-cube relationship with the substrate: $(001)_f \| (001)s$ and $[100]_f \| [100]_s$. From the d-values of the (002) and (111) diffraction peaks, the lattice parameter for TiN and AlN is very close, such as α=4.24 Å for TiN, and a=4.2 Å for AlN, consistent with the Ti atoms in TiN are substituted by Al atoms with smaller atomic radius. $(Ti_{1-x}Al_x)N$ can form solid solution without phase separation. From the above XRD analysis for AlN films on quartz glass, hexagonal structure of AlN should be a stable phase other than cubic structure. However, epitaxial cubic structure AlN can be grown on $SrTiO_3$ or $LaAlO_3$ as the substrate.

The surface morphology of all the films was checked by SEM. The films were found very smooth without obvious difference in SEM images. The surface roughness was checked by AFM. The films were dense, uniform and very smooth with grain size of around 10-14 nm, and with no detectable mico-cracks. The surface roughness was only 0.3 nm. TEM images for 45 nm thick $Ti_{0.5}Al_{0.5}N$ film annealed at 900° C. on $LaAlO_3$ indicated that the surface of the nitride film was very smooth and the interface between nitride and substrate was flat without any visible secondary phases. $Ti_{0.5}Al_{0.5}N$ was amorphous with around 10-20% crystallinity as some Moire Fringes were observed in the high resolution TEM images, consistent with a very weak (002) peak was observed from θ-2θ XRD scan. EDS shows the film contain Ti, Al and N elements.

Figure 7A:
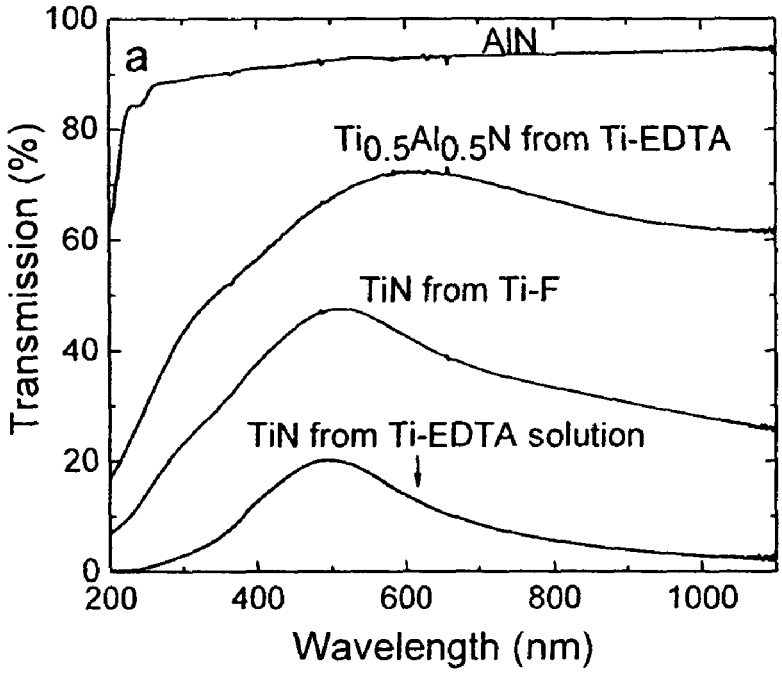
FIG. 7(*a*) shows optical transmission spectrum for TiN, $Ti_{0.5}Al_{0.05}N$ and AlN on quartz glass where TiN films were prepared from Ti—F and Ti-EDTA solutions.
Figure 7B:
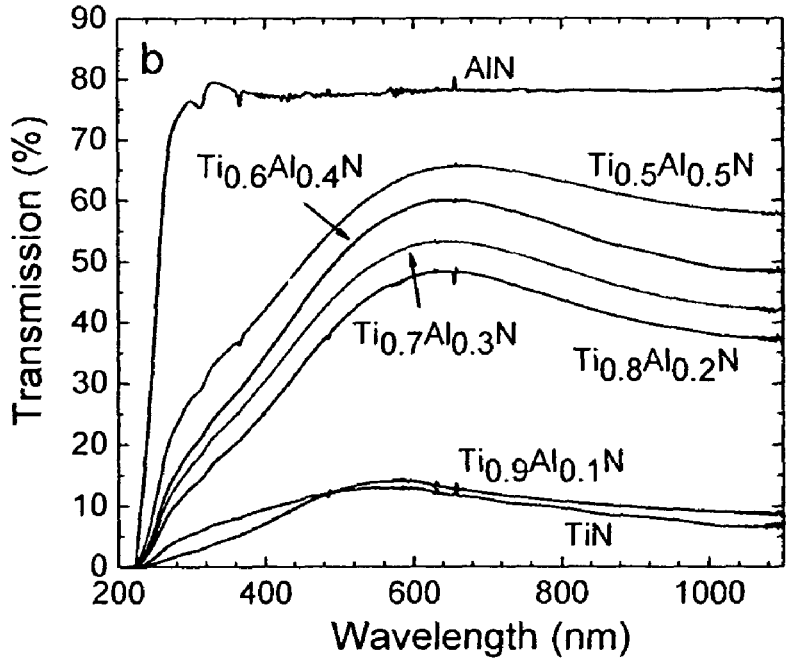

FIGS. 7(*a-b*) show the optical transmission characteristics of TiN, AlN and $(Ti_{0.5}Al_{0.5})N$ films on quartz glass, and $(Ti_{1-x}Al_x)N$ (x=0, 0.1, 0.2, 0.3, 0,4, 0.5 and 1) films on $LaAlO_3$ substrate. The optical properties of nitride films were measured on $LaAlO_3$ instead of $SrTiO_3$ because $SrTiO_3$ substrate is small for optical measurement. AlN film is highly transparent, having an optical transmission of 80-90% in the wavelength range of 300-1100 nm for the film on quartz glass, and 75-80% on $LaAlO_3$ substrate. As expected, transmission is decreasing as Ti doped in AlN films, such as $(Ti_{0.5}Al_{0.5})N$ film has transmission of 60-70% in wavelength of 500-1100 nm on both of quartz and $LaAlO_3$. Nitride films from two different Ti solutions have been deposited, and the transmission was found higher for TiN and $Ti_{0.5}Al_{0.5}N$ films by using Ti—F solution than those from Ti-EDTA solution.

Figure 8:
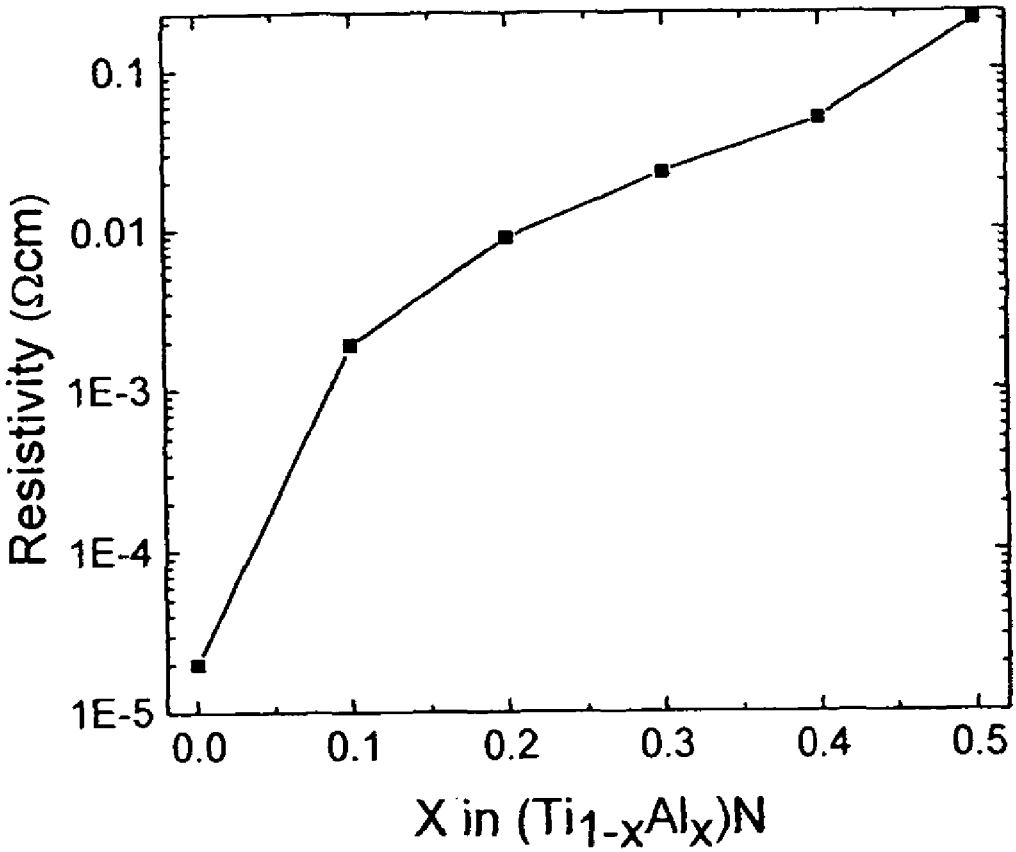
FIG. 8 shows the composition dependency of room temperature resistivity of $Ti_{1-x}Al_xN$ films where TiN and $Ti_{0.9}Al_{0.1}N$ films were prepared from Ti—F solutions, and all other films were prepared from Ti-EDTA solutions.

TiN conducts electricity similar to metal, but AlN is a very good insulator. The TiN films on quartz, and epitaxial TiN films on $SrTiO_3$ or $LaAlO_3$ substrate, were highly conductive from Ti—F solution with room-temperature resistivity of 20 μΩ·cm. The composition dependent of room-temperature resistivity of epitaxial $Ti_{1-x}Al_xN$ films is shown in FIG. 8. The resistivity of $(Ti_{0.9}Al_{0.1})N$ film is two orders of magnitude higher than that of TiN film. The electric resistivity of the films increases exponentially with the increase of Al doping. In other words, $Ti_{1-x}Al_xN$ system shows a large decrease in resistivity compared to pure AlN film, which is in the range of $10^{11}$-$10^{14}$ Ω·cm. The resistivity for all the films prepared from two different Ti solutions were checked. It was found that TiN and $Ti_{0.9}Al_{0.1}N$ films from Ti—F solutions showed higher conductivity with one order of magnitude higher than those from Ti-EDTA solutions, while $Ti_{0.8}Al_{0.2}N$ films showed almost the same resistivity from two solutions, however, $Ti_{0.5}Al_{0.5}N$ films had one order of magnitude higher conductivity from Ti-EDTA solution than those from Ti—F solutions. Thus resistivity of $(Ti_{1-x}Al_x)N$ films can be controlled by adjusting the compositions and by using different solutions. The dependence of the resistivity of $(Ti_{0.9}Al_{0.1})N$ films on deposition temperature and on film thickness were also investigated. A high deposition temperature decreases the resistivity, however, a clear change in resistivity as function of film thickness was not found.

TiN, AlN and $(Ti_{1-x}Al_x)N$ films have been successfully epitaxial cube-on-cube grown on (001) $SrTiO_3$ or LAO substrates by a polymer-assisted deposition technique. TiN is highly conductive with room-temperature resistivity of 20 μΩ·cm. The electrical resistivity increased exponentially with the increase of Al doping amount in $Ti_{1-x}Al_xN$ films. AlN is very transparency with the optical transmittance of 80-90% in the wavelength of 300-1100 nm. The transmission decreased with increasing Ti doping in AlN films.

The present invention is more particularly described in the following examples which are intended as illustrative only, since numerous modifications and variations will be apparent to those skilled in the art.

Examples A-F describe the preparation of solutions used in the deposition and formation of the metal nitride films or other metal nitride containing films. Examples 1-2 describe the deposition of such metal nitride films or other metal nitride containing films using such solutions. Polyethyleneimine was obtained from BASF as a water free, branched, polymer with an average MW of 50,000. Water was deionized via reverse osmosis (having a resistivity >16 Ohms).

EXAMPLE A

Samples were prepared as follows. The precursor for the growth of $Ti_{1-x}Al_xN$ films was prepared by mixing two separate aqueous solutions of Ti and Al bound to polymers. Water used in the solution preparation was purified using the Milli-Q water treatment system. Polyethyleneimine (PEI), ethylenediaminetetraacetic acid (EDTA) were purchased from BASF Corporation of Clifton, N.J., and used without further purification. Ultrafiltration and concentration were carried out using Amicon stirred cells and 3000 molecular weight cut-off, flat cellulose filter disks (YM3) under 60 psi (1 psi=6.89 kPa) nitrogen pressure. Metal analysis was conducted with a Varian Liberty 220 inductively coupled plasma-atomic emission spectrometer (ICP-AES), following the standard SW846 EPA (Environmental Protection Agency) Method 6010 procedure.

Two kinds of Ti solutions were prepared. One will be referred to as "Ti—F" solution. In detail, 12 g of hexafuorotitanic acid (60 wt % $H_2TiF_6$ in water) were added to 7.5 g PEI in 40 mL water. The final concentration of Ti was 496 mM. The other will be referred to as "Ti-EDTA" solution. Small aliquots of the titanium solution (a mixture of 2.5 g of 30% peroxide into 30 mL water and then slowly adding 2.5 g titanium tetrachloride) were added to a solution containing 1 g PEI, 1 g EDTA and 30 mL water, while maintaining pH at 7.5, until precipitation occurred. The final Ti concentration was 408 mM.

The Al solution was formed using aluminum nitrate bound to fluorinated PEI polymer (PEI-F was prepared by slowly adding 5 mL 48% hydrofluoric acid to 10 g PEI in 40 mL water, while maintaining pH at 7). Aluminum nitrate hydrate (2 g) was added to 3 g PEI-F in 40 mL water. The final concentration of Al was 200.6 mM.

EXAMPLE B

Alternatively, the Al solution was formed as follows. Aluminum nitrate nonahydrate and ethylenediaminetetraaceticacid and polyethylenimine: Two grams of ethylenediaminetetraaceticacid was placed in a 50 mL Falcon tube and 40 mL of nanopure water were added. The ethylenediaminetetraaceticacid does not dissolve at this stage. 2.6 of aluminum nitrate nonahydrate was added to the solution followed by 2.2 g of polyethylenimine (BASF) and the solution was agitated until everything was dissolved. After stirring the solution was placed in an Amicon filtration unit containing a PM 10 filter designed to pass materials having a molecular weight <10,000 g/mol. The solution was diluted to 200 mL and then concentrated to 10 mL in volume. Final concentration of aluminum was 119 mM.

EXAMPLE C

A solution including gallium chloride and polyethylenimine in ethanol was prepared as follows. An amount of 5 grams of polyethylenimine were dissolved in 95 grams of ethanol. The solution was dried over molecular sieves for two days and then filtered through a 0.49 micron filter. About 20 mL of the solution were placed in a 50 mL Falcon tube and 0.6 grams of gallium chloride were added in an inert atmosphere. A precipitate appears and then dissolves into solution. This solution was placed in an Amicon ultrafiltration unit containing a YM 10 ultrafiltration membrane designed to pass materials having a molecular weight<10,000 g/mol. The solution was diluted to 200 mL with absolute ethanol and then concentrated to 10 mL in volume. After filtration, the viscosity of the solution was further increased by removing a small amount of solvent by rotary evaporation under reduced pressure. Inductively coupled plasma-atomic emission spectroscopy showed that the final solution had 14.3 mg/mL of Ga.

EXAMPLE D

A solution including gallium-doped zinc was prepared as follows. An amount of 200 mg of the concentrated solution from example N was mixed with 3.8 grams of the solution from example B. The resulting solution was clear and homogenous. This method can be used to generate a wide variety of gallium doped zinc solutions by simply mixing in the appropriate ratios.

EXAMPLE E

Metals can be bound to PEI as fluoride complexes as follows. Gallium nitrate (1.0 g) was dissolved in 20 mL of water followed by the addition of 0.67 g of ammonium bifluoride to generate the $GaF_6^{3-}$ anion. PEI (1.0 g) was then added and the mixture was purified by Amicon filtration.

EXAMPLE F

Metals can also be bound to PEI as EDTA complexes of the metals. For a solution of zinc chloride, dipotassium ethylenediaminetetraacetic acid and polyethylenimine, 2.0 grams of dipotassium ethylenediaminetetraacetic acid were dissolved in 30 mL of water. Then, 0.75 grams of zinc chloride were added and the solution was stirred. After stirring, 2 grams of polyethylenimine were added. The solution was placed in an Amicon filtration unit containing a PM 10 filter designed to pass materials having a molecular weight<10,000 g/mol. The solution was diluted to 200 mL and then concentrated to 20 mL in volume. Inductively coupled plasma-atomic emission spectroscopy showed that the final solution was 373 mM Zn. The other metals including Hf, Ga, Nd, Y, Ba, Sr, Bu, Mn, Ce, In, Eu, La, Al, Ca, and Pb were each bound to PEI as EDTA complexes of the metals in a similar manner. The particular metal concentrations of these solutions are shown in Table 1.

TABLE 1

| Metal Salt | Polymer | EDTA | Final [metal] |
|---|---|---|---|
| 1.0 g $HfOCl_2$ | 1.0 g PEI | 1.0 g | 155 mM |
| 1.0 g $Ga(NO_3)_3$ | 1.0 g PEI | 1.0 g | 230 mM |
| 1.5 g $PbCl_2$ | 1.5 g PEI | 1.5 g | 234 mM |
| 3.0 g $La(NO_3)_3$ | 2.0 g PEI | 2.0 g | 172 mM |
| 1.3 $Y(NO_3)_3$ $6H_2O$ | 1.0 g PEI | 1.0 g | 115 mM |
| 1.5 g $Nd(NO_3)_3$ 6 $H_2O$ | 1.0 g PEI | 1.0 g | 158 mM |
| 1.5 g $CeCl_3$ 7 $H_2O$ | 1.2 g PEI at pH 4 | 1.2 g | 134 mM |
| 1.0 g $EuCl_3$ | 1.0 g PEI | 1.0 g | 136 mM |
| 0.5 g $Ca(OH)_2$ | 4.0 g PEI | 4.0 g | 152 mM |
| 1.7 g $MnCl_2$ hydrate | 1.8 g PEI | 1.7 g | 216 mM |
| 1.7 g $Al_2(SO_4)_3$ hydrate | 1.9 g PEI | 1.7 g | 182 mM |
| 2.0 g $Al(NO_3)_3$ hydrate | 2.0 g PEI | 2.0 g | 245 mM |
| 1.0 g $Bi(NO_3)_3$ | 1.0 g PEI | 1.0 g | 101 mM |

EXAMPLE 1

Gallium nitride was prepared with a solvent of water or ethanol using $GaF_6^{3-}$ bound to the PEI. The solution from example CC is readily spin coated and is then thermally treated in an ammonia atmosphere to generate the gallium nitride film.

EXAMPLE 2

$Ti_{1-x}Al_xN$ films were prepared with the solutions of Example A. The precursors with desired stoichiometric molar ratio were formed by mixing the solutions and spin coated onto quartz glass, (001) $SrTiO_3$ or (001) $LaAlO_3$ substrates at 2000 rpm for 30 seconds. The coated substrates were heated slowly in forming gas (a mixture of about 6% hydrogen and about 94% nitrogen by volume) at 510° C. for 2 hours, then in ammonia gas at 900-1000° C. for 1 hour, resulting in $Ti_{1-x}Al_xN$ films.

X-ray diffraction (XRD) was used to characterize the crystallographic orientation of the films. The surface morphology of the films was analyzed by scanning electron microscopy (SEM). The optical properties such as the transmission and the absorption of films were measured using an ultraviolet-visible (UV-VIS) spectrometer. The electrical resistivity (ρ) was measured at room-temperature using a standard four-probe technique.

Although the present invention has been described with reference to specific details, it is not intended that such details should be regarded as limitations upon the scope of the invention, except as and to the extent that they are included in the accompanying claims.

What is claimed is:

1. A process of preparing a uniform metal nitride film comprising:

preparing a homogeneous solution of metal-bound polymer by combining a soluble metal precursor and a soluble polymer selected from the group consisting of polyethyleneimine, derivatives of polyethyleneimine, polyacrylic acid, and poly(ethylene-maleic acid) in a suitable solvent, applying the homogeneous solution onto a substrate to form a polymer and metal containing layer thereon, heating said substrate in a reducing atmosphere at temperatures and for time characterized as sufficient to remove said polymer from said polymer and metal containing layer and form a uniform metal nitride film.

2. The process of claim 1 wherein said heating said substrate includes first heating said substrate in a hydrogen-containing atmosphere at temperatures and for time characterized as sufficient to remove said polymer from said polymer and metal containing layer and second further heating said substrate in an ammonia atmosphere at temperatures and for time characterized as sufficient to form a conformal metal nitride film.

3. The process of claim 2 wherein said reducing atmosphere is a mixture of hydrogen and nitrogen.

4. The process of claim 3 wherein said reducing atmosphere is a mixture of about 6 percent hydrogen and about 94 percent nitrogen by volume.

5. The process of claim 1 wherein said metal is titanium, aluminum or gallium.

6. The process of claim 1 wherein said metal is a titanium and aluminum mixture.

7. The process of claim 1 wherein said metal is molybdenum, niobium, titanium, aluminum or gallium.

* * * * *